United States Patent [19]

Macchi et al.

[11] Patent Number: 4,547,095

[45] Date of Patent: Oct. 15, 1985

[54] METHOD FOR THE CONSTRUCTION, TRANSPORTATION AND SITE INSTALLATION OF A DEEP-SEA LATTICE STRUCTURE

[75] Inventors: Carla Macchi, Brescia; Franco Nicolussi, Venice, both of Italy

[73] Assignee: Tecnomare S.p.A., Venice, Italy

[21] Appl. No.: 592,567

[22] Filed: Mar. 23, 1984

[30] Foreign Application Priority Data

Mar. 30, 1983 [IT] Italy ..... 84108 A/83

[51] Int. Cl.[4] ..... E02B 17/00

[52] U.S. Cl. ..... 405/206; 405/195; 405/204

[58] Field of Search ..... 405/195, 203–208, 405/224, 225; 175/5, 7; 114/264

[56] References Cited

U.S. PATENT DOCUMENTS

| | | | |
|---|---|---|---|
| 2,597,110 | 5/1952 | Lacy | 405/204 |
| 2,598,088 | 5/1952 | Wilson | 405/204 |
| 3,347,052 | 10/1967 | Steitle et al. | 405/205 |
| 3,641,774 | 2/1972 | Hekkanen et al. | 405/204 |
| 3,729,940 | 5/1973 | Koehler | 405/205 |
| 3,736,756 | 6/1973 | Lloyd | 405/204 |
| 4,027,493 | 6/1977 | Guy | 405/204 |
| 4,094,162 | 6/1978 | Allee | 405/207 X |
| 4,193,714 | 3/1980 | Gjerde | 405/195 X |

*Primary Examiner*—Dennis L. Taylor

*Attorney, Agent, or Firm*—Birch, Stewart, Kolasch & Birch

[57] ABSTRACT

A method for the construction, transportation and site installation of a gravity-supported deep-sea lattice structure, characterized by using a dry dock only for constructing the base of the structure, this latter then being completed in protected deep water by successively welding leg portions prefabricated in different construction yards, the welding being done using floating docks, one for each leg, which are provided with lifting and welding equipment and also with automatic raising and liquid ballasting systems, and are connected to said legs in a manner releasable from and slidable along them, to enable the structure under construction to be lowered in a controlled manner after each welding operation, so as to always return it to its initial state and thus make the joining of the leg portions by welding a repetitive operation, the floating docks also being used as pontoons for supporting the structure when, having been made to re-emerge to approximately half its height by means of their said automatic raising and liquid ballasting systems, it is towed to its installation site in the open sea, where it is completely ballasted.

6 Claims, 16 Drawing Figures

METHOD FOR THE CONSTRUCTION, TRANSPORTATION AND SITE INSTALLATION OF A DEEP-SEA LATTICE STRUCTURE

This invention relates to a method which, in a simple and economical manner, rapidly and without requiring complex operations, allows the construction, transportation and site installation of a deep-sea lattice structure, such as a single mooring, a loading tower or, more specifically, a gravity-supported fixed steel platform of tripod type for supporting hydrocarbon drilling and production plants.

Various types of constructional, transportation and installation methods for deep-sea steel structures are already known in the state of the art.

One of these known methods involves a tripod platform formed from a central column and three inclined tubular legs, the construction of which however presents serious assembly problems and lengthy construction times due to the constructional difficulties in a dry dock and the large number of welds which have to be made on cylindrical pipe portions of small length and very large thickness. Moreover, the high weight of the structure due to the large diameters and thicknesses concerned leads to considerable complications and high risks in transporting the individual tubular elements by floating, and also requires particularly complicated and costly maring operations in the open sea.

A further known method involves again a tripod platform, and a lattice structure constituted by a tower in the form of legs and comprising hinged foundation bases. This structure is completely constructed in a dry dock and is transported with its hinge-connected structural elements folded so that they lie in the same plane, with small draft.

However, such a method has considerable drawbacks such as the need for a large dry dock in order to be able to contain the entire platform folded on to one side, and to which the foundation bases are then connected in protected waters. Alternatively, the individual main structural parts can be constructed and then assembled in protected waters, but this procedure can be highly criticised because of the need to simultaneously use several pontoons and the complexity of the launching operations and of the marine operations in general. Further drawbacks of this second method derive from the fact that one or more large construction sites have to be kept occupied for a long period, from the geometrical complexity of the joints, from the need for continuous tests on the operation of the hinges, and the need to check that the structure can be properly folded back into place before its final transportation to its place of installation. Moreover, the fact that large surfaces are exposed to the action of the waves during towing leads to obvious considerable transportation difficulties and requires the use of many large floats to give auxiliary thrust, and in addition great difficulties are involved in the installation, in which the structure has to be folded back into its final configuration, rotated and then lowered, the overall result being extended working times and thus excessive costs.

The object of the present invention is to obviate the aforesaid drawbacks by providing a new method for the construction, transportation and deep-sea site installation of a lattice marine structure, which considerably reduces costs, risks, and the time necessary for installing said structure.

This is attained substantially in that only the structure base is constructed in a dry dock, the entire structure then being completed in protected deep water using modular preassembled small-dimension elements which can be constructed in different construction yards, thus leading to a consequent reduction in both the construction time and the required size of the dry dock, the elements being joined together by simple marine operations, using floating docks with an automatic raising system and connected in an easily and rapidly releasable manner to the longitudinal members of the legs of the lattice structure under construction, and along which said floating docks can slide, and are also used as floating pontoons to give the complete structure additional floatability and stability during its towing to its place of installation in the open sea. In this respect, it is apparent that by using such floating docks, which are provided with equipment for lifting and welding the prefabricated structural parts to be joined together and also with liquid ballasting and automatic raising systems which allow the progressive controlled lowering of the structure under construction at the end of each welding operation, thus making the operations necessary for assembling the structure repetitive and simple and not placing any lmitation on the dimensions of the structure which can be constructed, the construction being limited only by the protected water depth available, it is possible to also effectively and economically solve the serious problem of towing the structure to its place of installation in the open sea, by eliminating the need for costly and bulky floats which are difficult to remove. A further advantage of the invention is that a strong monolithic structure is obtained free from complicated joints such as hinges, concrete poles etc.

Thus, the method for the construction, transportation and site installation of a gravity-supported deep-sea lattice structure comprising a base from which several lattice legs branch to support a plant carrying deck at their ends above the water, is characterised according to the present invention by comprising the following stages in succession:

in a dry dock, constructing said base, to which the first leg portions are welded;

towing said lower self-floating part of the lattice structure from said dry dock to a protected deep water zone by means of a tug;

connecting a floating dock to each leg portion of said lower part of the structure in such a manner that it can be released from and slide along said leg portion, said floating dock being provided with lifting and welding equipment and with automatic raising and liquid ballasting systems;

joining the second leg portions, one per leg, to the pre-existing part of the structure, said portions being prefabricated in different construction yards, brought to site by pontoons, and positioned and welded to the underlying structure by means of the cranes and the welding means of said floating docks;

in a controlled manner, lowering the structure obtained after said joining operations by means of said liquid ballasting and automatic raising systems on the floating docks in order to return it to its initial state in which it is arranged for the joining of the next portions;

continuing the joining of further leg portions by repeating the two latter said stages until approximately one half of the forseen height for the lattice structure is reached;

joining to the structure under assembly an intermediate lattice girder system for stiffening the structure by means of loading operations consisting of positioning the lattice girder supported by a pontoon on the connection cones of the underlying structure, making the structure re-emerge by removing liquid ballast until said lattice girder becomes mounted on to it, removing the pontoon and carrying out the necessary welding operations;

repeating the operations for joining the other leg portions, and completing the structure summit by means of the floating dock cranes;

removing from said floating docks the cranes, machinery and plant used only for the construction, and, by operating the liquid ballasting and automatic raising systems on said floating docks, causing the assembled structure to re-emerge to about one half its height, i.e. to the allowable draft level along the transportation route and which provides sufficient nautical floatability and stability to said structure;

using tugs, towing the assembled structure from said protected deep water zone to its place of installation in the open sea using the floating docks as pontoons for providing additional support and allowing temporary control of the marine operations;

lowering the structure to the depth at which it is stable without the floating docks by operating the liquid ballasting system and the automatic raising system on these latter;

removing and recovering all the floating docks except for one floating dock together with its liquid ballasting and automatic raising system, by which the total lowering of the structure is completed; and finally also recovering this latter floating dock and loading said plant carrying deck on to the lattice structure in the usual operational manner.

According to a preferred embodiment of the present invention, said marine lattice structure is a gravity-supported fixed platform in the form of a tripod lattice structure for supporting hydrocarbon drilling and production plants in deep seas, in which the base is constituted by a lattice girder system with its base in the form of an equilateral triangle, to the vertices of which there are connected three foundation bases and from the vertices of which there branch three triangular-based lattice legs which are inclined in accordance with the lateral edges of a right pyramid having said lattice girder system as its base, and are connected together at half the height of the platform by an intermediate triangular lattice girder system for stiffening purposes, to converge at their summit above the water in order to support the plant carrying deck. A further characteristic of the present invention is that each floating dock is connected in a manner releasable from and slidable along the respective leg of the structure under construction by roller units which cooperate with the longitudinal members of said leg.

According to a modification of the present invention, each floating dock is connected in a manner releasable from and slidable along the respective leg of the structure under construction by means of gear wheels driven by motors, and engaging with racks provided along the longitudinal members of said leg.

Finally, in order to prevent disengagement of said gear wheels from the racks and more generally to prevent deterioration of the releasable and slidable engagement between the floating docks and the respective lattice legs, according to a further modification of the present invention immediately before said stage in which the assembled structure is towed by tugs to its place of installation in the open sea, there is effected a stage in which the floating docks are rigidly connected to the longitudinal members of the relative legs of the structure.

The invention is described in detail hereinafter with reference to the accompanying drawings which illustrate a preferred embodiment thereof by was of non-limiting example in that technical and constructional modifications can be made thereto, without leaving the scope of the present invention.

In said drawings:

FIG. 4 is a front view of the lower part of the platform during the first stage involving the construction in the dry dock;

FIG. 5 is a diagrammatic plan view of the three adjacent floating docks connected to each of the three legs of said lower part of the platform after towing into protected deep water;

FIG. 6 is a front view of FIG. 5;

FIG. 7 is a partial perspective view to an enlarged scale of a floating dock connected to a leg portion;

FIG. 8 is a front view of the lower part of the platform after joining the second three leg portions;

FIG. 9 shows the structure under construction of FIG. 8, after having been lowered into the same state as at the beginning of assembly as shown in FIG. 6, i.e. in the configuration preceding the repetitive joining operations;

FIG. 10 is a front view showing the intermediate triangular stiffening lattice girder system being loaded into position;

FIG. 11 is a front view showing the last stages in the construction of the platform, with the floating docks adjoining each other;

FIG. 12 is a front view showing the use of the loading dock cranes for the structural completion of the platform;

FIG. 13 is an isometric line diagram of the structure with the three stripped floating docks in the towing position;

FIG. 14 is a front view showing the structure after re-emerging through the floating docks to about half its height during its towing by tugs from the protected deep water zone to its place of installation in the open sea;

FIG. 15 is a frontal view showing the structure partially lowered in its place of installation and two floating docks removed;

FIG. 16 is a frontal view of the structure completely installed on the sea bed.

Figure 4:
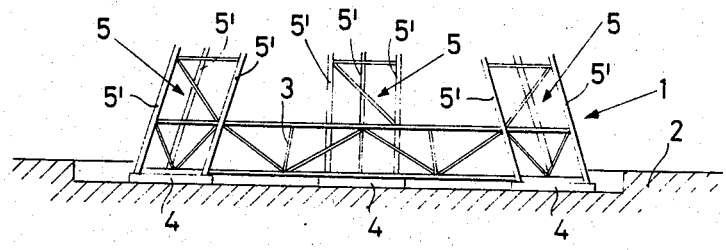
FIGS. 4 to 16 show the different stages of the method according to the invention, and more specifically.

In the figures, the reference numeral 1 indicates the lower part of the platform to be constructed by the method of the invention, this part being prepared in a dry dock 2 (see FIG. 4) by welding to the vertices of a lattice girder system 3, in the form of an equilateral triangle with a side of about 220 meters, the three foundation bases 4 and the first three portions of the legs 5, which also have a triangular base of side about 40 meters and comprise longitudinal members 5' of about 4.5 meters diameter, these being welded inclined in accordance with the lateral edges of a right triangular pyramid with an angle depending on the required height for the platform.

Figure 5:
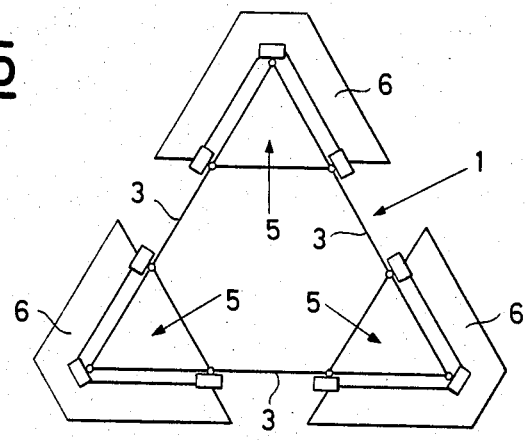
Figure 6:
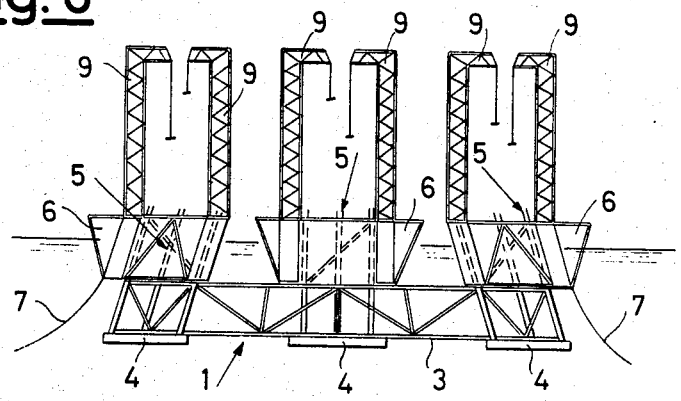
Figure 7:
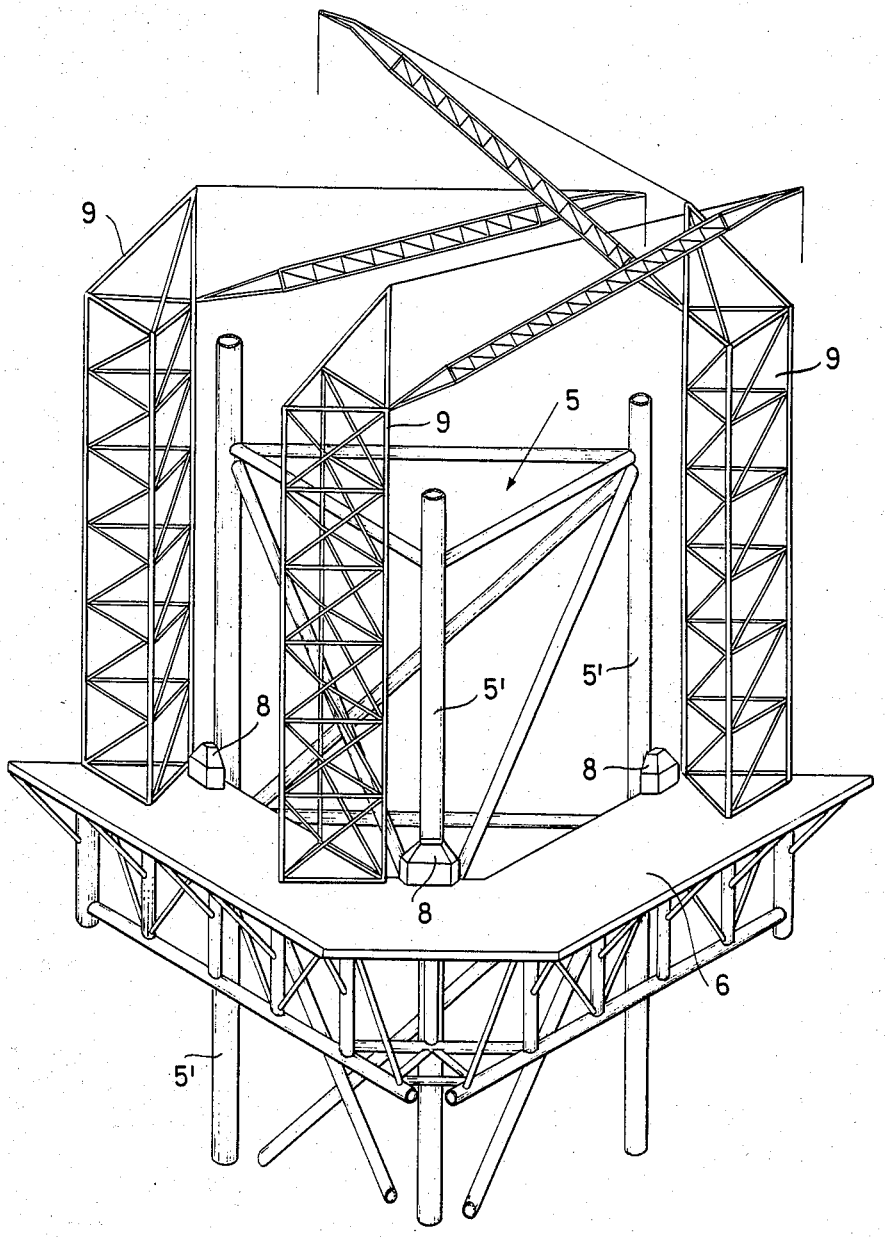

After this self-floating structure, having a height of about 80 meters, has been towed by tugs to a protected deep water zone, a floating dock 6 (FIGS. 5 and 6) is brought up to each of its leg portions 5 and connected thereto in a releasable and slidable manner, it being anchored to the sea bed by anchoring cables 7. Said connection between the floating docks and legs is made by means of the three elements 8 (see FIG. 7) of the floating dock, which cooperate with the three longitudinal members 5' of the leg, said elements being either roller units or gear wheels (not shown in the figure) which engage with racks provided along said longitudinal members 5' of the leg.

Figure 8:
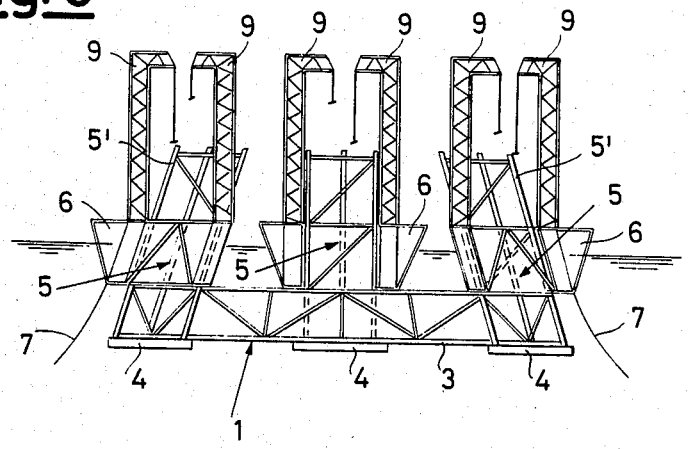

The floating docks 6 are fitted with lifting equipment or cranes 9 (FIG. 6) by which a further three leg portions (see FIG. 8) brought to the construction site by pontoons are lifted and positioned on the underlying structure.

Figure 9:
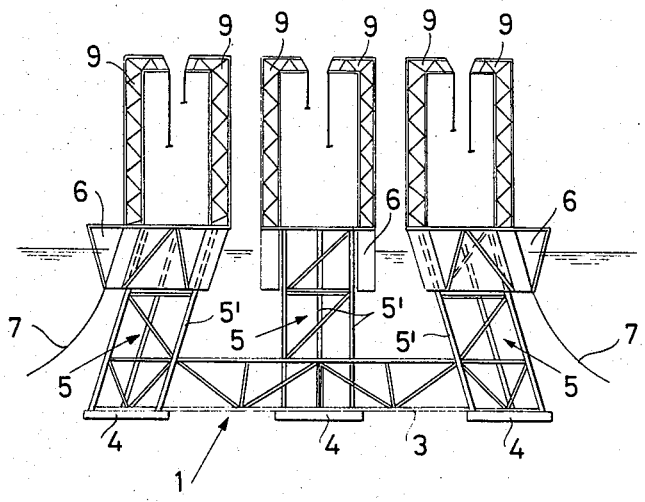

As soon as these latter portions have been welded by the welding equipment, not shown in the figure, but provided on the floating docks 6, the assembled structure is lowered by operating the liquid ballasting and automatic raising systems located on the three floating docks 6 (see FIG. 9), in order to facilitate the joining operations for the next three leg portions and make these operations repetitive.

This joining is continued by repeating the same operations until the level of the intermediate triangular stiffening girder system 10 at about half the platform height is reached, this girder system then being loaded into position.

Figure 10:
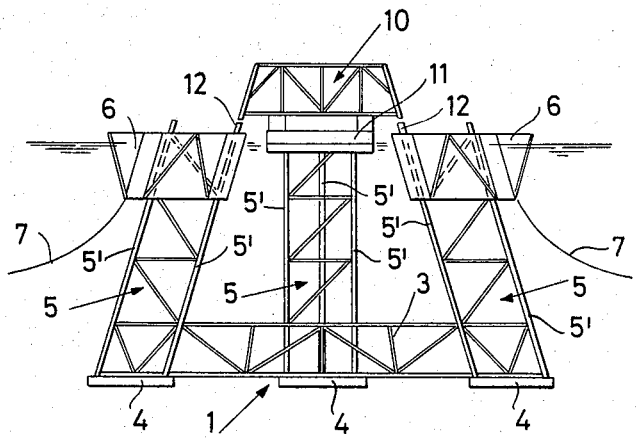

The girder system 10, loaded on the pontoon 11 (see FIG. 10), is positioned over the connection cones 12 situated on the underlying part of the structure, which is then made to re-emerge by removing liquid ballast until it receives said girder system. The pontoon 11 is then removed, and finally the necessary welding operations are carried out.

Figure 12:
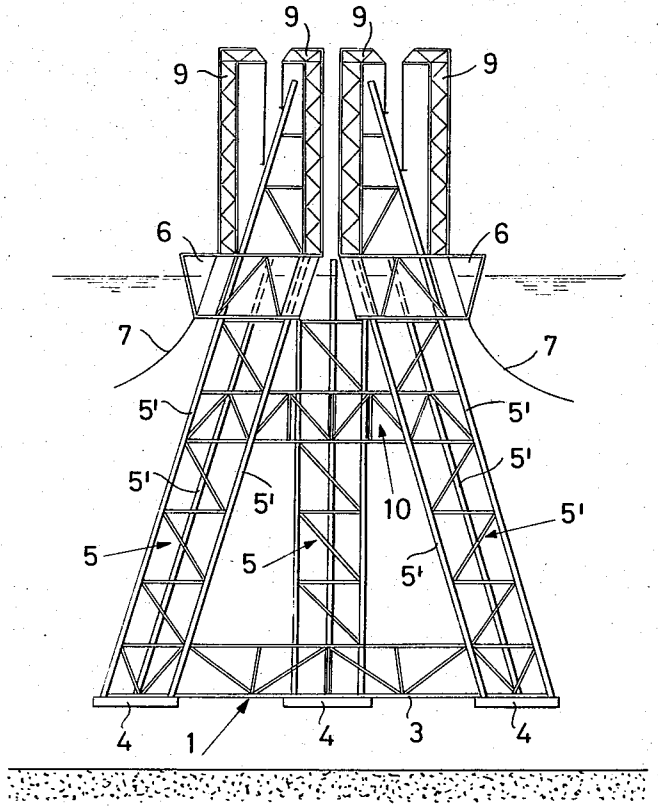
Figure 11:
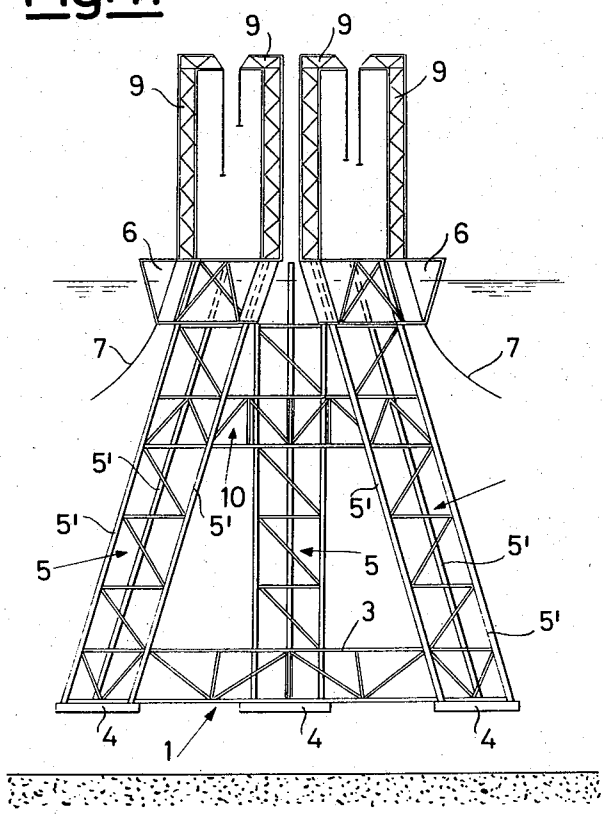

The construction is continued by the described procedures until the structure summit is completed, this being done without any further lowering and using merely the cranes 9 of the floating docks 6, which now adjoin each other (see FIG. 12).

The completely assembled structure is then prepared for transportation from the protected deep water zone to its installation zone in the open sea.

Figure 13:
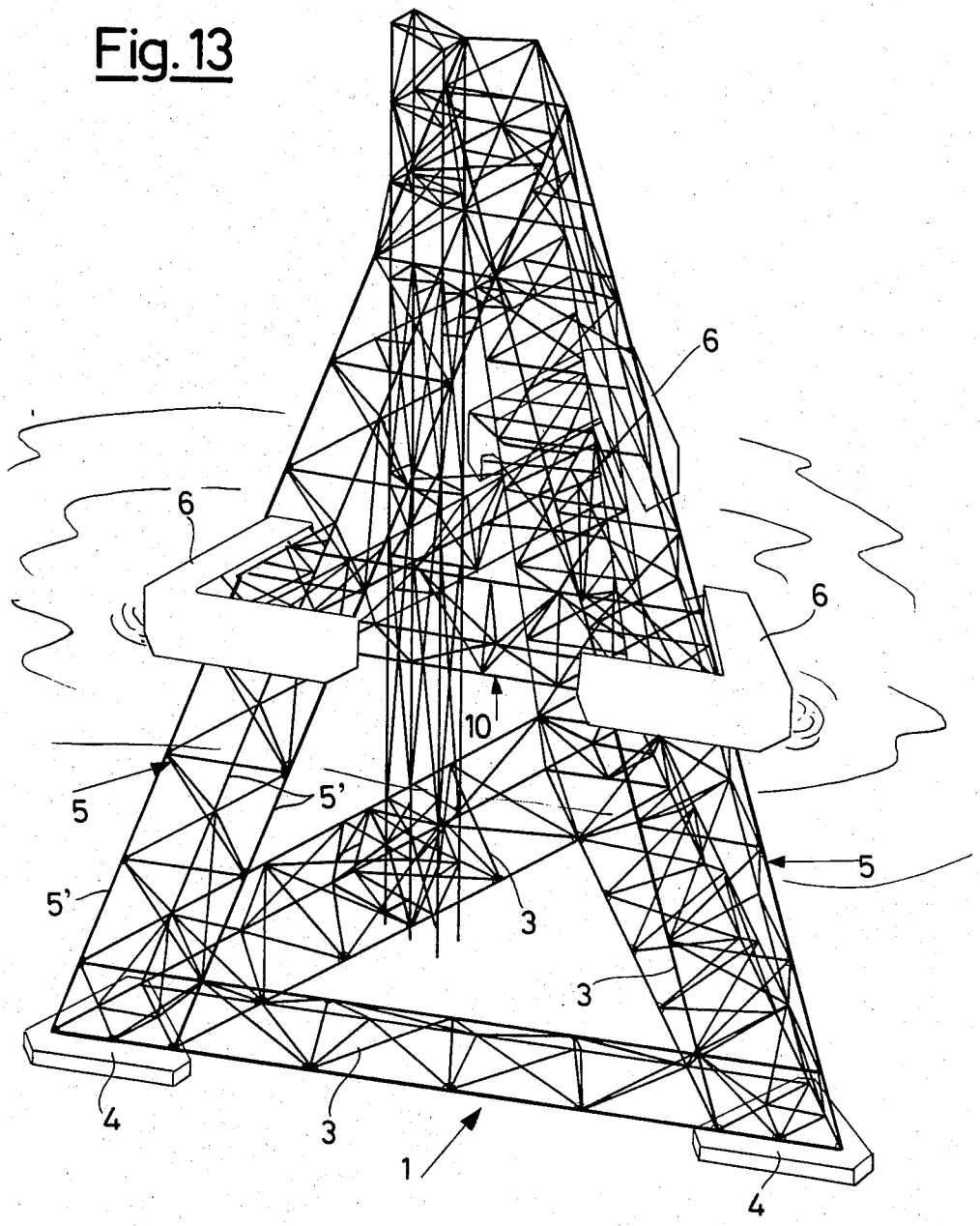

For this purpose, the cranes 9 and all the machinery and plant used only for the constructional stage are removed from the floating docks 6, and by operating the liquid ballasting and automatic raising systems on said docks the tripod is made to re-emerge to about one half its height (see FIG. 13) in order to make its draft the minimum possible compatible with sufficient nautical floatability and stability.

Figure 14:
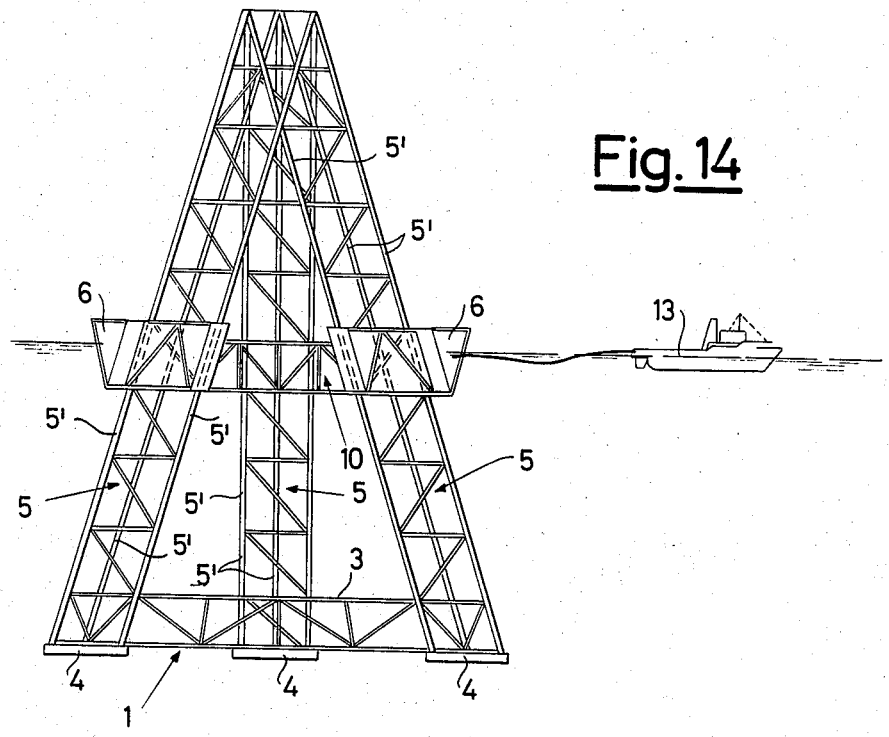

At this draft, the floating docks 6 are rigidly connected to the longitudinal members 5' of the legs 5, and the platform is then towed by tugs 13 (see FIG. 14) while using the floating docks 6 as pontoons to give additional support and to allow temporary control of the marine operations.

Figure 1:
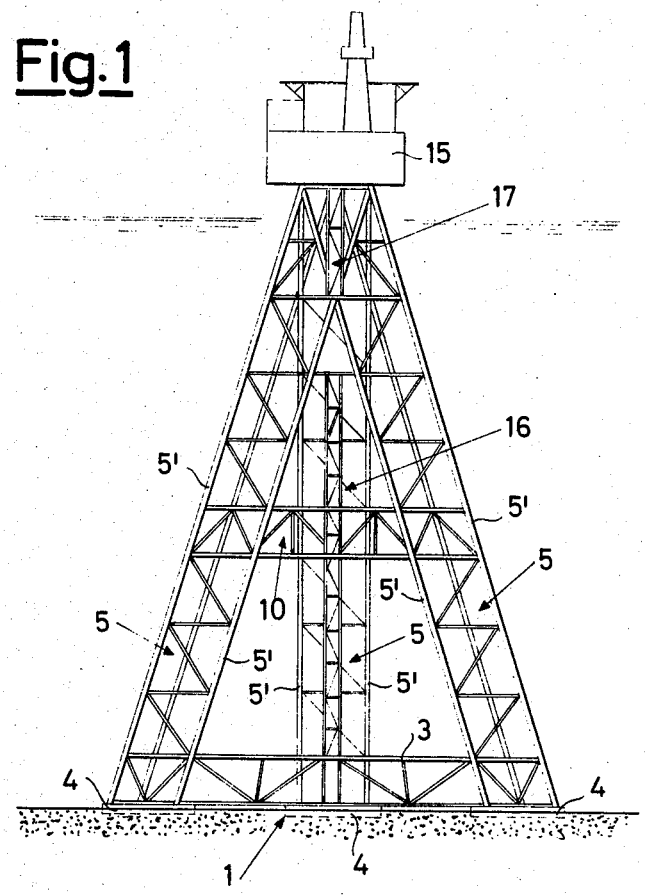
FIG. 1 is a front view of a gravity-supported fixed platform of lattice structure in the form of a tripod constructed in accordance with the method of the invention.
Figure 2:
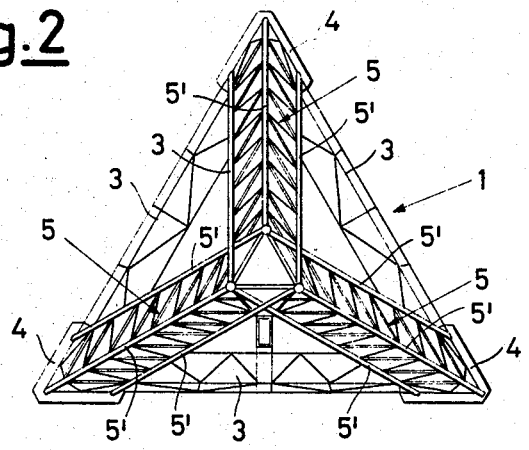
FIG. 2 is a plan view of the platform of FIG. 1, with the plant carrying deck removed for clarity.
Figure 3:
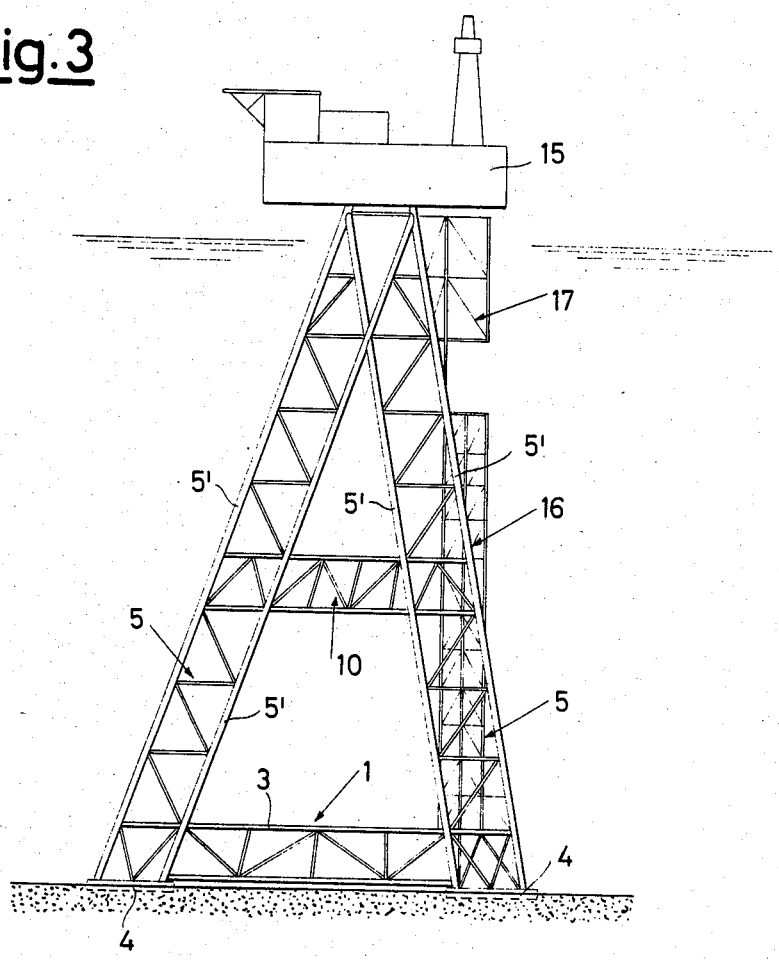
FIG. 3 is a side view of the platform of FIG. 1.
Figure 15:
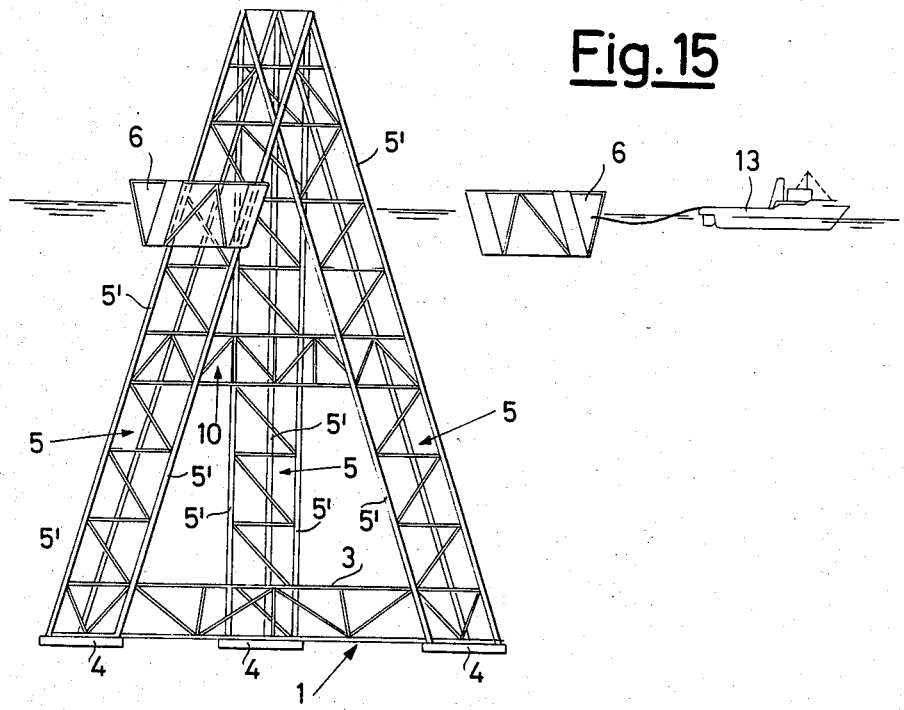
Figure 16:
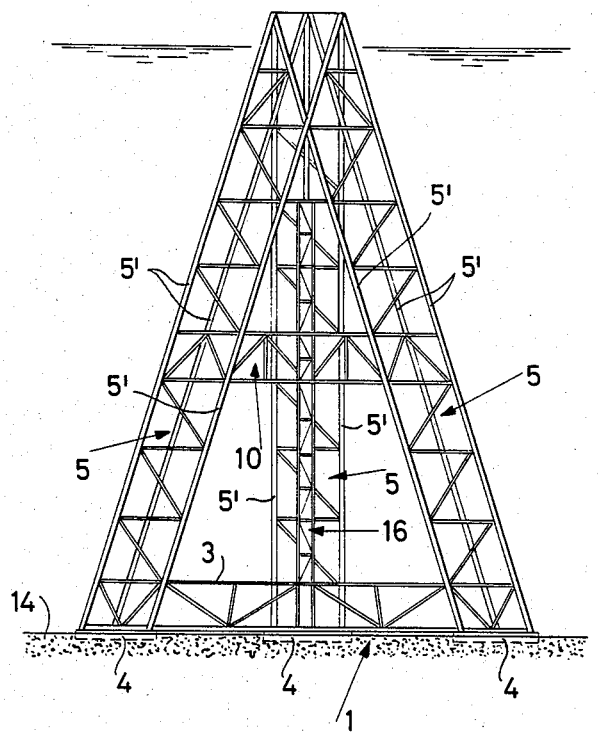

Having reached the installation zone, the structure is positioned and retained by the tugs or by anchoring systems, and the installation operation is commenced by lowering the structure to a depth at which it is stable without the floating docks, so that two of these can be removed (see FIG. 15). The platform is then completely lowered on to the sea bed 14 (see FIG. 16) by operating the liquid ballasting system controlled by the third floating dock (see FIG. 15). The plant-carrying deck 15 (see FIGS. 1 and 3) is then loaded on to the platform, and the connections are made between the underwater deposit and the plants on the deck by the usual methods, using vertical pipes.

The figures also show the guide tube support tower which juts from the main structure and is constituted by two separate portions 16 and 17 (see FIGS. 1, 3 and 16), which are hinged to the structure at their upper ends and are connected permanently thereto by means of concrete poles.

We claim:

1. A method for the construction, transportation and site installation of a gravity-supported deep-sea lattice structure comprising a base from which several lattice legs branch to support a plant-carrying deck at their ends above the water, characterised by comprising the following stages in succession:

in a dry dock, constructing said base, to which the first leg portions are welded;

towing said lower self-floating part of the lattice structure from said dry dock to a protected deep water zone by means of a tug;

connecting a floating dock to each leg portion of said lower part of the structure in such a manner that it can be released from and slide along said leg portion, said floating dock being provided with lifting and welding equipment and with automatic raising and liquid ballasting systems;

joining the second leg portions, one per leg, to the pre-existing part of the structure, said portions being prefabricated in different construction yards, brought to site by pontoons, and positioned and welded to the underlying structure by means of the cranes and the welding means of said floating docks;

in a controlled manner, lowering the structure obtained after said joining operations by means of said liquid ballasting and automatic raising systems on the floating docks in order to return it to its initial state in which it is arranged for the joining of the next portions;

continuing the joining of further leg portions by repeating the two latter said stages until approximately one half of the forseen height for the lattice structure is reached;

joining to the structure under assembly an intermediate lattice girder system for stiffening the structure by means of loading operations consisting of positioning the lattice girder supported by a pontoon on the connection cones of the underlying structure, making the structure re-emerge by removing liquid ballast until said lattice girder becomes mounted on to it, removing the pontoon and carrying out the necessary welding operations;

repeating the operations for joining the other leg portions, and completing the structure summit by means of the floating dock cranes;

removing from said floating docks the cranes, machinery and plant used only for the construction, and, by operating the liquid ballasting and automatic raising systems on said floating docks, causing the assembled structure to re-emerge to about one half its height, i.e. to the allowable draft level along the transportation route and which provides sufficient nautical floatability and stability to said structure;

using tugs, towing the assembled structure from said protected deep water zone to its place of installation in the open sea using the floating docks as pontoons for providing additional support and allowing temporary control of the marine operations;

lowering the structure to the depth at which it is stable without the floating docks by operating the liquid ballasting system and the automatic raising system on these latter;

removing and recovering all the floating docks except for one floating dock together with its liquid ballasting and automatic raising system, by which the total lowering of the structure is completed; and finally also recovering this latter floating dock and loading said plant carrying deck on to the lattice structure in the usual operational manner.

2. A method for the construction, transportation and site installation of a gravity-supported deep-sea lattice structure as claimed in claim 1, characterised in that said structure is a gravity-supported fixed platform in the form of a tripod lattice structure for supporting hydrocarbon drilling and production plants in deep seas, in which the base is constituted by a lattice girder system with its base in the form of an equilateral triangle, to the vertices of which there are connected three foundation bases and from the vertices of which there branch three triangular-based lattice legs which are inclined in accordance with the lateral edges of a right pyramid having said lattice girder system as its base, and are connected together at half the height of the platform by an intermediate triangular lattice girder system for stiffening purposes, to converge at their summit above the water in order to support the plant carrying deck.

3. A method for the construction, transportation and site installation of a gravity-supported deep-sea lattice structure as claimed in claim 1, characterised in that each floating dock is connected in a manner releasable from and slidable along the respective lattice leg of the structure under construction by means of roller units which cooperate with the longitudinal members of said leg.

4. A method for the construction, transportation and site installation of a gravity-supported deep-sea lattice structure as claimed in claim 1, characterised in that each floating dock is connected in a manner releasable from and slidable along the respective lattice legs of the structure under construction by means of gear wheels driven by motors, and engaging with racks provided along the longitudinal members of said leg.

5. A method for the construction, transportation and site installation of a gravity-supported deep-sea lattice structure as claimed in claim 1, characterised in that immediately before said stage in which the assembled structure is towed by tugs from said protected deep water zone to its place of installation in the open sea, there is effected a stage in which the floating docks are rigidly connected to the longitudinal members of the relative legs of the structure.

6. A method for the construction, transportation and site installation of a gravity-supported deep-sea lattice structure as claimed in claim 4, characterised in that immediately before said stage in which the assembled structure is towed by tugs from said protected deep water zone to its place of installation in the open sea, there is effected a stage in which the floating docks are rigidly connected to the longitudinal members of the relative legs of the structure.

* * * * *